US005756002A

United States Patent [19]

Chen et al.

[11] Patent Number: 5,756,002

[45] Date of Patent: May 26, 1998

[54] CLEANING SOLVENTS CONTAINING BENZOTRIFLUORIDE AND FLUORINATED COMPOUNDS

[75] Inventors: Hang-Chang Bobby Chen, Getzville; Edward A. Rowe, Grand Island, both of N.Y.

[73] Assignee: Occidental Chemical Corporation, Niagara Falls, N.Y.

[21] Appl. No.: 644,143

[22] Filed: May 10, 1996

[51] Int. Cl.[6] ..... B01F 1/00; C23G 5/028; C23G 5/032

[52] U.S. Cl. ..... 252/364; 510/176; 510/200; 510/285; 510/365; 510/407; 510/412; 510/411; 510/409; 510/177

[58] Field of Search ..... 252/364; 510/175, 510/176, 177, 200, 276, 285, 365, 371, 407, 408, 409, 410, 411, 412; 134/38, 40

[56] References Cited

U.S. PATENT DOCUMENTS

| | | | |
|---|---|---|---|
| 4,232,072 | 11/1980 | Pardee | 428/65 |
| 4,578,209 | 3/1986 | Hisamoto et al. | 510/412 |
| 5,244,507 | 9/1993 | Rowe | 134/38 |
| 5,403,514 | 4/1995 | Matsuhisa et al. | 252/364 |
| 5,578,381 | 11/1996 | Hamada et al. | 428/447 |

OTHER PUBLICATIONS

CA: 125:36361 entitled: "Non-Flamable Mixed Solvent Compositions, Cleaning Method, and Appartus" by Matsuhida et al. (Apr. 4, 1996).

Chemical Abstract No. 122:280137 by Nalewajek et al. entitled "Multiple Solvent Cleaning System" (1994).

*Primary Examiner*—Joseph D. Anthony

*Attorney, Agent, or Firm*—Richard D. Fuerle; Arthur S. Cookfair

[57] ABSTRACT

A cleaning solvent comprising (A) about 3 to about 20 wt % of a fluorinated compound selected from the group consisting of (1) fluorocarbons having the general formula $$C_mH_nF_{2m+2-n}$$

where m is 4 to 8, and n is 0 to m/2 if m is even and 0 to (m+1)/2 if m is odd;

(2) $C_5F_{11}NO$;

(3) alkyl perfluoroethers having the general formula $$R_1OR_2$$

where $R_1$ is $C_3F_7$ or $C_4F_9$ and $R_2$ is $CH_3$ or $C_2H_5$; and (4) fluorochlorocarbons having the general formula $$C_pH_qCl_rF_{2p+2-q-r}$$

where p is 3, 4, or 5, q is 1 to p−1, and r is 1 to p−1;

(B) up to about 15 wt % of a $C_1$ to $C_4$ alkanol; and (C) the remainder benzotrifluoride.

20 Claims, No Drawings

CLEANING SOLVENTS CONTAINING BENZOTRIFLUORIDE AND FLUORINATED COMPOUNDS

CROSS-REFERENCE TO RELATED APPLICATION

This application is related to application Ser. No. 08/644,145 pending, filed of even date by E. A. Rowe and H. C. Chen, titled "Improved Cleaning Composition Containing Benzotrifluoride," and to application Ser. No. 08/644,144 pending, filed of even date by E. A. Rowe and H. C. Chen, titled, "Rapidly Evaporating Cleaning Compositions."

BACKGROUND OF THE INVENTION

This invention relates to a cleaning solvent. In particular, it relates to a blend of benzotrifluoride and a fluorinated compound.

In manufacturing electronics, textiles, and apparel, it is necessary to remove grease, oil, and other soils left by machinery. In manufacturing electronic components it is often necessary to remove rosin fluxes. Specialized solvents are sometimes required for this purpose because the rosin fluxes are a mixture of polar and non-polar compounds. For this reason, flammable solvents are sometimes necessary and the requisite safety precautions are already in place.

A solvent that was widely used in industry for cleaning is 1,1,1-trichloroethane because it is non-flammable, has a low odor, readily dissolves greases and oils, and has a rapid evaporation rate, which is important for high speed processing. However, 1,1,1-trichloroethane has now been banned because it has found to be an ozone depletor. As a result, there is a great need in the industry for a substitute solvent that has some or all of the desirable properties of 1,1,1-trichloroethane, but which is not an ozone depletor.

SUMMARY OF THE INVENTION

We have discovered that a very good cleaning solvent can be made from a blend of benzotrifluoride and a fluorinated compound. This blend will actually clean better than the fluorinated compound by itself. Surprisingly, although benzotrifluoride is a flammable solvent, we have found that it can be made non-flammable with the addition of only a small amount of the fluorinated compound.

DESCRIPTION OF THE PREFERRED EMBODIMENTS

The blends of this invention comprise a mixture of about 80 to about 90 wt % benzotrifluoride (BTF) and about 3 to about 20 wt % of a fluorinated compound. Four types of fluorinated compounds are used in the blends of this invention: fluorocarbons, $C_5F_{11}NO$, alkyl perfluoroethers, and fluorochlorocarbons.

Fluorocarbons are compound having the general formula $$C_mH_nF_{2m+2-n}$$

where m is 4 to 8, and n is 0 to m/2 if m is even and 0 to (m+1)/2 if m is odd. Preferably, at least one hydrogen is present because hydrofluorocarbons (i.e., $n \geqq 1$) have a finite atmospheric lifetime and therefore are not greenhouse gases as perfluorocarbons (i.e., n=0) may be. Examples of suitable hydrofluorocarbons include dihydrodecafluoropentane (DHDFP), and hexafluorobutane. The preferred hydrofluorocarbon is DHDFP because it is commercial and is environmentally acceptable. Examples of perfluorocarbons include perfluorohexanes, perfluoropentanes, and perfluoroheptanes. The preferred perfluorocarbon is perfluorohexane because its boiling point is close to the boiling point of benzotrifluoride.

The compound $C_5F_{11}NO$ has the formula

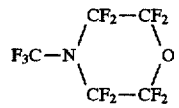

It is commercially available.

Alkyl perfluoroethers that can be used have the general formula $R_1OR_2$ where $R_1$ is a straight chain saturated perfluorocarbon radical from $C_3$ to $C_4$ (i.e., $C_3F_7$ or $C_4F_9$) and $R_2$ is methyl or ethyl (i.e., $CH_3$ or $C_2H_5$). Examples of suitable alkyl perfluoroethers include isopropylperfluoroethyl ether, and isopropylperfluoromethyl ether. Isopropylperfluoroethyl ether is preferred because its vapor pressure is close to the vapor pressure of BTF.

The fluorochlorocarbon can be straight or branched and has the formula $$C_pH_qCl_rF_{2p+2-q-r}$$

where p is 3, 4, or 5, q is 1 to p−1, and r is 1 to p−1. Examples of suitable fluorochlorocarbons include $C_3H_2Cl_2F_4$, $C_3Cl_3F_5$, $C_3Cl_2F_6$, $C_4ClHF_8$, and $C_4Cl_2H_2F_6$. Preferably, the hydrogen (or hydrogens) are in the center of the molecule because they are more easily made. The preferred fluorochlorocarbons have the empirical formula $C_3HCl_2F_5$ because they are more commercially available.

In order for a blend of BTF with a fluorocarbon to be non-flammable, at least about 15 wt % hydrofluorocarbon is required, but only at least 3 wt % perfluorocarbon compound is required. At least about 3 wt % $C_5F_{11}NO$, at least about 15 wt % alkyl perfluoroether, and at least about 5 wt % fluorochlorocarbon is required for non-flammability. To provide a margin of safety, the preferred compositions contain at least about 2 wt % more fluorinated compound than is required for non-flammability.

Small amounts, up to about 15 wt %, of a $C_1$ to $C_4$ alkanol can be included in the composition in order to aid in cleaning inorganic compounds. Preferably, about 3 to about 10 wt % alkanol is included in the composition. The preferred alkanol is isopropanol (IPA) because it is environmentally acceptable.

The composition of this invention is a single phase composition and remains a liquid from below about −50° C. to the boiling point of the particular fluorinated compound used. The composition can be used to clean electronics, textiles, for contact cleaning, and for general cleaning. In addition, it can also be used as a solvent carrier for powdered metals, as an ink carrier, or in gravure printing. It can be used as a liquid wash or as an aerosol. Other uses will no doubt be apparent to those skilled in the art.

The following examples further illustrate this invention.

EXAMPLE 1

(Flash Point)

BTF was mixed with various hydrofluoro, hydrochlorofluoro, and perfluoro compounds, and the mixtures were tested for flash point using ASTM test D 5687, known as the Tag Closed Tester. The fluorinated compounds tested were 1,1,1,2,3,4,4,5,5,5-decafluoropentane, a hydrofluorocarbon sold by DuPont as "HFC-43-10," $C_5F_{11}NO$, sold by 3M as "PFC-5052," and dichloro pentafluoro propane, a hydrofluorocarbon sold by Asahi Glass as "HCFC-225." The following table summarizes the results:

| Compound/Mixture | Tag Closed Cup Flash Point (°F.) |
|---|---|
| 100 wt % BTF | 54 |
| 3 wt % HFC 43-10, 97 wt % BTF | 57 |
| 5 wt % HFC 43-10, 95 wt % BTF | 55 |
| 15 wt % HFC 43-10, 85 wt % BTF | NFTB* |
| 25 wt % PFC-5052, 75 wt % BTF | NFTB |
| 5 wt % PFC-5052, 95 wt % BTF | NFTB |
| 2.5 wt % PFC-5052, 97.5 wt % BTF | NFTB |
| 30 wt % HCFC-225,70 wt % BTF | NFTB |
| 15 wt % HCFC-225, 85 wt % BTF | NFTB |

(*No Flash To Boiling)

The above table shows that only small concentrations of the fluorinated compounds are required for non-flammability.

For comparison, another commonly used non-flammable cleaning solvent, perchloroethylene, was blended with BTF for the flash point tests. It was found that there was only a slight elevation of BTF's flash point when 75 wt % of perchloroethylene was added.

EXAMPLE 2

(Cleaning)

The ability of various solvents to clean mineral oil and solder flux was determined by weight difference. Approximately the same amount, 30 mg of mineral oil or 10 mg of solder flux, was brushed onto 7.6 cm (3 inch) by 1.3 cm (½ inch) steel coupons. The coated coupons were weighed and placed into a 20 ml test solvent for 30 seconds, 2 minutes, and 4 minutes. No agitation was provided. The coupons were taken out, allowed to air dry for at least 30 minutes, and re-weighed. The difference in weight measured the extent of cleaning. This test was repeated three times for each solvent and cleaning time combination. The traditional cleaning solvent, 1,1,1-trichloroethane (1,1,1-TCA), was also included for comparison. The following table gives the results:

Weight % of Mineral Oil Left On Coupon

| Cleaning Time | 1,1,1-TCA | BTF | 85/15 (by wt) BTF/HFC 43-10 | 80/15/5 (by wt) BTF/HFC 43-10/IPA |
|---|---|---|---|---|
| 30-second | 3.6 | 1.9 | 2.9 | 4.4 |
| 2-minute | 1.1 | 0.3 | 0.7 | 0.5 |
| 4-minute | 0.5 | 0.4 | 0.7 | 0.5 |

Weight % of Nokorode Solder Flux Left On Coupon

| Cleaning Time | 1,1,1-TCA | BTF | 85/15 (by wt) BTF/HFC 43-10 | 80/15/5 (by wt) BTF/HFC 43-10/IPA |
|---|---|---|---|---|
| 30-second | 11.3 | 17.1 | 28.7 | 19.0 |
| 2-minute | 1.5 | 3.5 | 2.5 | 0.7 |
| 4-minute | 1.3 | 1.6 | 2.0 | 1.6 |

The above tables show that the solvents of this invention are comparable to 1,1,1-TCA after 4 minutes.

EXAMPLE 3

(Aerosol Flammability Test)

This example shows that the addition of a hydrofluoro, hydrochlorofluoro, or perfluoro compound reduces the flammability of a BTF aerosol. This was demonstrated by the length of the flame propagation in an aerosol spray using ASTM test D 3065-72. The tests were conducted in a draft-free area. The aerosol dispenser, which contained the test fluid, was shaken, held upright, positioned 15 cm (6 inches) from a candle flame, and sprayed for 4 seconds through the top ⅓ of the flame. The following table discloses the test results, where each reported number is the average of three measurements:

| Solvent/ Solvent Mixture | Flame Propagation Length | Flashback Length |
|---|---|---|
| BTF | 35 cm (13.7") | 7 cm (2.7") |
| 15 wt % HFC 43-10 85 wt % BTF | 31 cm (12.3") | 5 cm (2.0") |
| 37.5 wt % HFC 43-10 62.5 wt % BTF | 28 cm (11.0") | 4.6 cm (1.8") |
| 50 wt % HFC 43-10 50 wt % BTF | Sporadic to None | None |
| HFC 43-10 | None | None |

The above table shows that the mixtures become non-flammable according to this test at HFC-43-10 concentrations of at least 50 wt %.

We claim:

1. A composition comprising (A) about 3 to about 20 wt % of a fluorinated compound selected from the group consisting of (1) fluorocarbons having the general formula $$C_mH_nF_{2m+2-n}$$

where m is 4 to 8, and n is 0 to m/2 if m is even and 0 to (m+1)/2 if m is odd;

(2) $C_5F_{11}NO$;

(3) alkyl perfluoroethers having the general formula $$R_1OR_2$$

where $R_1$ is $C_3F_7$ or $C_4F_9$ and $R_2$ is $CH_3$ or $C_2H_5$; and (4) fluorochlorocarbons having the general formula $$C_pH_qCl_rF_{2p+2-q-r}$$

where p is 3,4, or5, q is 1 to p−1, and r is 1 to p−1;

(B) up to about 15 wt % of a $C_1$ to $C_4$ alkanol; and (C) the remainder benzotrifluoride, where said composition is single phase and is suitable for use as a cleaning composition.

2. A composition according to claim 1 wherein said fluorinated compound is a perfluorocarbon having the general formula $$C_mF_{2m+2}.$$

3. A composition according to claim 1 wherein said fluorinated compound is dihydrodecafluoropentane.

4. A composition according to claim 1 wherein said fluorinated compound is a perfluorohexane.

5. A composition according to claim 1 wherein said fluorinated compound is a hydrofluorocarbon.

6. A composition according to claim 5 wherein said hydrofluorocarbon is 1,1,1,2,3,4,4,5,5,5-decafluoropentane.

7. A composition according to claim 1 wherein said fluorinated compound is a fluorochlorocarbon.

8. A composition according to claim 7 wherein said fluorochlorocarbon has the empirical formula $C_3H_2Cl_2F_4$.

9. A composition according to claim 1 wherein the amount of said alkanol is about 3 to about 10 wt %.

10. A composition according to claim 9 wherein said alkanol is isopropanol.

11. A composition according to claim 1 wherein said fluorinated compound is an alkyl perfluoroether.

12. A composition according to claim 11 wherein alkyl perfluoroether is isopropylperfluoroethyl ether.

13. A composition according to claim 11 wherein said fluorinated compound is a fluorochlorocarbon having the empirical formula $C_3HCl_2F_5$.

14. A solvent comprising at least about 80 wt % benzotrifluoride and an amount sufficient to make said solvent non-flammable of a fluorinated compound selected from the group consisting of (1) fluorocarbons having the general formula $C_mH_nF_{2m+2-n}$ where m is 4 to 8, and n is 0 to m/2 if m is even and 0 to (m+1)/2 if m is odd;

(2) $C_5F_{11}NO$;

(3) alkyl perfluoroethers having the general formula $R_1OR_2$ where $R_1$ is $C_3F_7$ or $C_4F_9$ and $R_2$ is $CH_3$ or $C_2H_5$; and (4) fluorocarbons having the general formula $C_pH_qCl_rF_{2p+2-q-r}$ where p is 3, 4, or 5, q is 1 to p−1, and r is 1 to p−1, where said solvent is single phase and is suitable for use as a cleaning solvent.

15. A solvent according to claim 14 wherein said fluorinated compound is a hydrofluorocarbon.

16. A solvent according to claim 14 wherein said fluorinated compound is an alkyl perfluoroether.

17. A solvent according to claim 14 wherein said fluorinated compound is a fluorochlorocarbon.

18. A composition comprising (A) a fluorinated compound selected from the group consisting of (1) about 15 to about 20 wt % of a hydrofluorocarbon having the general formula $C_mH_nF_{2m+2-n}$ where m is 4 to 8 and n is 1 to m/2 if m is even and 1 to (m+1)/2 if m is odd;

(2) about 3 to about 20 wt % of a perfluorocarbon having the general formula $C_mF_{2m+2}$ where m is 4 to 8;

(3) about 3 to about 20 wt % of a compound having the formula $C_5F_{11}NO$;

(4) about 15 to about 20 wt % of an alkyl perfluoroether having the general formula $R_1OR_2$ where $R_1$ is $C_3F_7$ or $C_4F_9$ and $R_2$ is $CH_3$ or $C_2H_5$; and (5) about 5 to about 20 wt % of a fluorochlorocarbon having the general formula $C_pH_qCl_rF_{2p+2-q-r}$ where p is3,4,or5,q is1 to p−1,and r is1 to p−1;

(B) up to about 15 wt % alkanol from $C_1$ to $C_4$; and (C) the remainder benzotrifluoride and where said composition is single phase, is suitable for use as a cleaning composition, is non-flammable.

19. A composition according to claim 18 wherein the amount of said alkanol is about 3 to about 10 wt %.

20. A composition according to claim 18 wherein said alkanol is isopropanol.

* * * * *